United States Patent [19]

Ogawa et al.

[11] 4,268,616

[45] May 19, 1981

[54] PROCESS FOR FORMING PHOTOGRAPHIC IMAGES

[75] Inventors: Junkichi Ogawa; Tsutomu Hamanka, both of Minami-ashigara, Japan

[73] Assignee: Fuji Photo Film Co., Ltd., Minami-ashigara, Japan

[21] Appl. No.: 113,160

[22] Filed: Jan. 18, 1980

Related U.S. Application Data

[63] Continuation-in-part of Ser. No. 17,671, Mar. 5, 1979, abandoned.

[30] Foreign Application Priority Data

Mar. 6, 1978 [JP] Japan ..... 53/25159

[51] Int. Cl.[3] ..... G03C 1/40

[52] U.S. Cl. ..... 430/364; 430/384; 430/385; 430/402; 430/552; 430/553; 430/565; 430/380

[58] Field of Search ..... 430/473, 565, 364, 470, 430/376, 480, 552, 553, 374, 384, 385, 402

[56] References Cited

U.S. PATENT DOCUMENTS

| | | | |
|---|---|---|---|
| 2,418,613 | 4/1947 | Allen et al. | 96/109 |
| 3,236,652 | 2/1966 | Kennard et al. | 96/109 |
| 3,253,915 | 5/1966 | Weyerts et al. | 96/3 |
| 3,459,549 | 8/1969 | McBride et al. | 96/109 |
| 3,674,490 | 7/1972 | Matejec | 430/376 |
| 3,776,730 | 12/1973 | Matejec et al. | 430/943 |
| 3,929,486 | 12/1975 | Habu et al. | 96/109 |
| 3,955,983 | 5/1976 | Nakajima et al. | 430/364 |
| 4,126,461 | 11/1978 | Popo | 96/95 |

FOREIGN PATENT DOCUMENTS

| | | | |
|---|---|---|---|
| 478984 | 1/1938 | United Kingdom | 430/473 |
| 1122085 | 7/1968 | United Kingdom | 430/480 |
| 1157959 | 7/1969 | United Kingdom | 96/66 |

*Primary Examiner*—Mary F. Downey

*Attorney, Agent, or Firm*—Sughrue, Rothwell, Mion, Zinn and Macpeak

[57] ABSTRACT

A process for forming photographic images comprising a silver image and a dye image, which comprises development processing an imagewise exposed silver halide photographic light-sensitive material in the presence of a carboxy- and sulfo-free naphthalene compound wherein at least two hydrogen atoms in the naphthalene nucleus are substituted at specific positions thereof as indicated in formula (I) below, and a 3-pyrazolidone compound.

21 Claims, No Drawings

PROCESS FOR FORMING PHOTOGRAPHIC IMAGES

This is a continuation-in-part of application Ser. No. 17,671, filed Mar. 5, 1979, now abandoned.

BACKGROUND OF THE INVENTION

1. Field of the Invention

This invention relates to a novel process for forming photographic images consisting of a silver image and a dye image, wherein the contribution of the dye image is at least 20% based on the total image, and, more particularly, to a process for obtaining suitable image density from a silver halide photographic light sensitive material which contains a relatively low amount of coated silver. The process of the present invention is particularly useful in the field of X-ray photography.

2. Discussion of the Prior Art

The increasing cost of silver halides tends to increase the production cost of photographic materials. This tendency is especially seen in the case of X-ray photographic materials since X-ray photographic materials have normally a very heavy coating weight of silver. Accordingly, various processes have been proposed directed to reducing the amount of silver while retaining the necessary image density. For example, there is a process of forming a dye image together with a metallic silver image to secure photographic images of adequate density in the sum of the both images as described in U.S. Pat. Nos. 3,615,509, 3,622,629, 2,181,944, West German Patent Nos. 1,158,836 and 537,923, British Pat. Nos. 492,518, Japanese Patent Application (OPI) Nos. 37,539/72, 4,725/77 and 57,827/77. So far these processes have not been put into practice due to the difficulty in obtaining high image density for the amount of coated silver or due to the comparatively high price of the materials for forming images.

British Pat. No. 1,122,088 has also proposed a process for the production of photographic images consisting of metallic silver together with a blue dye which comprises subjecting an imagewise exposed silver halide photographic material to development with a developer comprising 1-phenyl-3-pyrazolidone and 4-methoxy-1-naphthol. However, this process using 4-methoxy-1-naphthol is not yet satisfactory, in addition to the aforementioned disadvantages, in that color hue of the so obtained dye image is blue.

Apart from such a concept as reducing the consumption of silver, it is known to use dihydroxy naphthalene derivatives, which are structurally similar to those used in this invention, in the photographic system for quite different purposes. For example 1,3-dihydroxynaphthalenes having a carboxy or sulfo group are employed as antifoggants in U.S. Pat. No. 3,929,486 issued to Habu et al. A similar use of 1,4-dihydroxynaphthalenes as antifoggants is also described in U.S. Pat. No. 2,418,613. Further, 2,3-dihydroxynaphthalenes are described in U.S. Pat. No. 3,236,652 issued to Kennard et al and used as chelating agents. In U.S. Pat. No. 3,459,549 issued to McBride et al, bridged 1,4- and 1,2-dihydroxynaphthalenes are used as developing agents and antifoggants. While it is proposed to use such dihydroxy naphthalenes in the photographic system, these dihydroxynaphthalenes are not suitable for use in forming a dye image utilizing them, as intended in the present invention, since these naphthalenes cannot provide an appropriate electron transfer system associated with 3-pyrazolidone compounds. In more detail, where hydroxy groups are substituted at the 1- and 4-positions of the naphthalene nucleus, its developing activity is too strong and hence stability is very poor. Where hydroxy groups are substituted at the 1- and 3-positions thereof, the developing activity is rather too weak so that these dihydroxynaphthalenes cannot be oxidized sufficiently to give a dye image. In addition, the aforesaid 1,3- and 2,3-dihydroxynaphthalenes mandatorily require the presence of water-solubilizing groups such as carboxy or sulfo which would adversely affect an electron transfer system between dihydroxynaphthalenes and 3-pyrazolidones necessary for achieving the purposes of this invention. The use of the bridged dihydroxynaphthalenes is, needless to say, against the intended cost reduction due to the increasing cost reflected by complicated routes of preparing such bridged dihydroxynaphthalenes.

SUMMARY OF THE INVENTION

An object of this invention is to provide a process of forming an image having a high maximum density ($D_{max}$), which is made up of a silver image and a dye image, using a silver halide photographic light-sensitive material containing a lower amount of coated silver.

Another object of this invention is to provide a process of forming an image, at least 20% of which is a dye image, thus reducing the consumption of silver by at least 20%.

A further object of this invention is to provide a process for preventing fog caused by a developing agent.

These objects of this invention have been successfully attained by processing an imagewise exposed silver halide photographic light-sensitive material in the presence of a naphthalene compound wherein at least two hydrogen atoms in the naphthalene nucleus are substituted by hydroxy groups at the 1,5-, 1,6-, 1,7-or 1,8-positions, and a 3-pyrazolidone compound.

The term "in the presence of" used herein refers to cases where the dihydroxynaphthalene compound and the 3-pyrazolidone compound are present (i) in any one of the silver halide emulsion layer and non-light-sensitive hydrophilic colloid layer associated with a silver halide emulsion layer, together or separately, (ii) they are present together in the same developer, and (iii) one of them is present in the light sensitive emulsion layer and the other in the developer, as will later be described in more detail.

DETAILED DESCRIPTION OF THE INVENTION

Photographic images formed by the process of this invention consist of a silver image and a dye image. This dye image is different than that in a conventional color photographic light-sensitive material in that it is not formed by the reaction between a color coupler and an oxidation product of aromatic primary amine developing agent. Also, it is different than the dye image formed by the autocoupling of a compound containing both silver halide-developing moiety and color coupler moiety in the same molecule (developer-coupler compound).

According to the process of this invention, the 3-pyrazolidone compound is used as a developing agent for forming a silver image and the hydroxynaphthalene compound functions to form a dye. While its mechanism is not clearly known, it is assumed that the 3-pyrazolidone compound would act as a cross oxidizing agent to form a 3-pyrazolidone radical and this radical would convert the dihydroxynaphthalene into its radical which would be subsequently oxidized to form a dye. Accordingly, an electron transfer between the 3-pyrazolidone compound and the dihydroxynaphthalene compound would take part in the formation of a dye image. In this process, aromatic primary amine developing agents, color couplers, etc. as required in the prior art processes are unnecessary.

The naphthalene compounds to be used in the present invention can be represented by the following general formula(I):

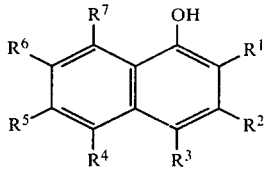

(I)

wherein $R^1$, $R^2$ and $R^3$ each represents a hydrogen atom or a group capable of imparting diffusion resistance, and $R^4$, $R^5$, $R^6$ and $R^7$ each represents a hydrogen atom, a hydroxy group or a group capable of imparting diffusion resistance, with at least one of $R^4$—$R^7$ representing a hydroxy group.

The above-described group capable of imparting diffusion resistance contains at least 8 carbon atoms and is known as a hydrophobic group or a ballast group. This ballast group is connected to the carbon atom of the naphthalene nucleus directly or through an amino bond, an ether bond, a thioether bond, a carboamido bond, a sulfoamido bond, a carbamoyl bond, a sulfamoyl bond, an ureido bond, an ester bond, an imido bond, a carbonyl bond, a sulfonyl bond, etc. Such ballast groups include, for example, an alkyl group, an alkenyl group, an alkoxyalkyl group, an alkylaryl group, an alkylaryloxyalkyl group, an acylamidoalkyl group, an alkoxyaryl group, an aryloxyaryl group, a carboxy- or sulfo-containing alkyl or alkenyl group, an ester-substituted alkyl group, an alkyl group substituted by a hetero ring or an aryl group, an alkyl group substituted by an aryloxyalkoxycarbonyl group, etc. These ballast or hydrophobic groups are well known to those skilled in the art. It is preferred that the diffusion resistance imparting group be one or $R^4$ through $R^7$.

The presence of water-solubilizing groups such as carboxy or sulfo adversely affect the electron transfer system to make it difficult to produce a dye utilizing the electron transfer system and is not desired in the process of this invention.

Of the naphthalene compounds represented by general formula (I), preferred naphthalene compounds are 1,5-, 1,6- and 1,7-dihydroxynaphthalenes. The compounds which are most preferably used in this invention are 1,5- and 1,7-dihydroxynaphthalenes, and derivatives thereof listed below.

These dihydroxynaphthalene compounds used in this invention provide a very high image density by adding a dye image density to a silver image density by at least 20%, which would contribute to enhancing the net optical density as compared to that due to the silver alone and thus reduce the consumption of silver by at least 20%. The contribution of the dye image to the net optical density of the photographic images is referred to herein as "dye contribution rate" which is expressed by percentage of the dye density obtained after eliminating the silver from the photographic images in a manner described in Example 1, to the total image density. The dye contribution rate reaches at least 20% according to the process of this invention. Where the greatest contribution of the dihydroxynaphthalene compound is mate, the dye contribution rate becomes as high as about 90%. In general, the dye contribution rate is between about 30 and about 60%. In other words, for a given optical density of images, the process of this invention enables to reduce the consumption of silver by about 20 to about 90% generally about 30 to about 60%.

Specific examples of the naphthalene compounds used in this invention are listed below. However, this invention is not limited to the use of these compounds.

I-1: 1,5-Dihydroxynaphthalene
I-2: 1,7-Dihydroxynaphthalene
I-3: 1,6-Dihydroxynaphthalene These compounds are shown in J. Kosar; *Light-Sensitive Systems,* published by John Wiley Co., in 1965, pp. 237-240.

The 3-pyrazolidone compound to be used in the present invention can be represented by following general formula (II):

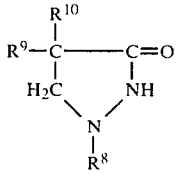

(II)

wherein $R^8$ represents an aryl group, and $R^9$ and $R^{10}$ each represents a hydrogen atom, an alkyl group or a hydroxyalkyl group.

The aryl group represented by $R^8$ is preferably a phenyl group. Preferably, this aryl group is not substituted.

The alkyl group represented by $R^9$ or $R^{10}$ preferably contains 1 to 4 carbon atoms and is straight or branched chain and is illustrated by for example, a methyl group, an ethyl group, a n-propyl group, an i-propyl group, a n-butyl group, a tert-butyl group, etc.

The hydroxyalkyl group represented by $R^9$ or $R^{10}$ preferably contains 1 to 4 carbon atoms in the alkyl moiety which may be straight or branched chain, and is illustrated by, for example, a hydroxymethyl group, a hydroxyethyl group, a hydroxypropyl group and a hydroxybutyl group.

Of the aryl groups represented by $R^8$, an unsubstituted phenyl group is particularly preferred.

Of the alkyl groups represented by $R^9$ or $R^{10}$, a methyl group is particularly preferred.

Of the hydroxyalkyl groups represented by $R^9$ or $R^{10}$, a hydroxymethyl group is particularly preferred.

Specific examples of the 3-pyrazolidone compounds to be used in the present invention are illustrated below, however, the present invention is not limited to the use of these compounds.

II-1: 1-Phenyl-4,4-dimethyl-3-pyrazolidone
II-2: 1-Phenyl-3-pyrazolidone
II-3: 1-Phenyl-4-methyl-3-pyrazolidone
II-4: 1-Phenyl-4-methyl-4-hydroxymethyl-3-pyrazolidone
II-5: 1-Phenyl-4,4-dihydroxymethyl-3-pyrazolidone In addition, compounds described in P. Glafkidis; *Chimic et Physique Photographiques,* p. 148, published by Paul Montel Co. (1976) can be used in the present invention.

The hydroxynaphthalene compounds and 3-pyrazolidone compounds used in the present invention are not new. Commercially available hydroxynaphthalene compounds can be used in the present invention. The synthesis thereof is set forth in PB-Report 74051, PB-Report 102,210, H. E. Fierz-David *Helv. Chim. Acta* 3, 318 (1920); A. H. Carter et al *J. Chem. Soc.* 1942 236; E. Bergmann *J. Chem. Soc.* 1948 1283, etc. The synthesis of the 3-pyrazolidones is disclosed in *J.A.C.S.*, 73, 919–926 (1951).

The silver image formed by the process of the present invention is substantially black. Although the color hue of the images obtained varies depending upon kind of a dye used, a black color is most preferred. The dye image formed by the process of this invention is substantially black including images tinted with other color such as brown as long as the naphthalene compound of formula(I) is employed. This dye image lies on the silver image to make up photographic images and increase the total image density, and, therefore, enables one to reduce the coating weight of silver necessary to obtain a given image density.

The hydroxynaphthalene compound or the 3-pyrazolidone compound may be incorporated in the silver halide emulsion layer or a non-light-sensitive hydrophillic colloid layer associated with a silver halide emulsion layer. The hydroxynaphthalene compound and the 3-pyrazolidone compound may be incorporated together in the same silver halide emulsion layer or hydrophillic colloid layer, or they may be incorporated in separate layers. Furthermore the hydroxynaphthalene compound and the 3-pyrazolidone compound may be incorporated together in the same developer solution or one of them may be incorporated in the light-sensitive emulsion layer and the other in the developer.

The hydroxynaphthalene compound or the 3-pyrazolidone compound may be incorporated alone or in combination in the developer or the light-sensitive material. In the case of incorporating the hydroxy naphthalene compound in the developer, it may be used in an amount of about 0.1 g/l to 30 g/l, preferably about 1 g/l to 20 g/l. The 3-pyrazolidone compound can be used in the developer in an amount of about 0.01 g/l to 5 g/l, preferably about 0.1 g/l to 3 g/l.

In the case of incorporating the compounds into the light-sensitive material, the hydroxynaphthalene compound may be used in an amount of about 0.1 $g/m^2$ to 10 $g/m^2$, preferably about 0.2 $g/m^2$ to 5 $g/m^2$, and the 3-pyrazolidone compound may be used in the light sensitive material in an amount of about 0.01 $g/m^2$ to 5 $g/m^2$, preferably about 0.1 $g/m^2$ to 2 $g/m^2$.

The processing used in the present invention fundamentally comprises a developing step and a fixing step and, if necessary, a water-washing step and a stopping step may be provided. A drying step may be provided after completing the processing. For example, the following development processing can be used: (1) developing, fixing and water washing, (2) a mono-bath of developing and fixing and water-washing, (3) developing, intensifying, fixing and water-washing, and (4) activation and water washing.

The processing temperature is usually about 10° C. to 70° C., with about 20° C. to 60° C. being preferable. The pH of the developer is about 7 to 14, and preferably about 8 to 11.

The developer may contain other known developer component compounds. For example, an alkali, a buffer agent, etc., sodium hydroxide, potassium hydroxide, sodium carbonate, potassium carbonate, sodium or potassium tertiary phosphate, potassium metaborate, borax, etc. may be used alone or in combination. Also, in order to impart buffering action or raise the ionic strength of the developer, or for the convenience of preparing processing solutions, there may further be used various salts such as disodium or dipotassium hydrogen phosphate, potassium or sodium dihydrogen phosphate, sodium or potassium bicarbonate, boric acid, alkali metal nitrates, alkali metal sulfates, etc.

However, it is important that if any sulfite is contained in the processing composition, it should be present in so low a proportion as not to prevent the formation of the dye image since it is known that the formation of the dye image is adversely affected (see British Pat. No. 1,122,085). Phrased differently, the sulfite should be present in the minimal necessary amount which would vary depending upon composition of developers such as auxiliary developing agents and is known to those skilled in the art.

An antifogging agent may be optionally incorporated into the developer. As such an antifogging agent alkali metal halides (e.g., potassium bromide, sodium bromide, potassium iodide, etc.) and organic antifogging agents can be used. Examples of organic antifogging agent are nitrogen-containing hetero ring compounds (e.g., benzotriazole, 6-nitrobenzimidazole, 5-nitroisoindazole, 5-methylbenzotriazole, 5-nitrobenzotriazole, 5-chlorobenzotriazole, etc.), mercapto-substituted hetero ring compounds (e.g., 1-phenyl-5-mercaptotetrazole, 2-mercaptobenzimidazole, 2-mercaptobenzothiazole, etc.), and mercapto-substituted aromatic compounds (e.g., thiosalicyclic acid). Particularly preferred antifogging agents are nitrogen-containing hetero ring compounds, especially nitrogen-containing hetero ring compounds not substituted by a mercapto group. The antifogging agents are generally used in an amount of about 1 mg to 5 g, preferably about 5 mg to 1 g, per 1 liter of the developer.

Additional examples of nitrogen-containing hetero ring compounds not substituted by a mercapto group are described in the following literature: Nitrobenzimidazole compounds are described in U.S. Pat. No. 2,496,940, British Pat. No. 403,789, U.S. Pat. Nos. 2,497,917, 2,656,271, etc. Benzotriazole compounds are described in *Journal of Photographic Society of Japan,* 11, 48 (1948). Hetero ring quaternary salts such as benzothiazolium salts are described in U.S. Pat. Nos. 2,131,038, 2,694,716, 3,326,681, etc. Tetrazaindene compounds are described in U.S. Pat. Nos. 2,444,605, 2,444,606, 2,444,607, etc., and other hetero ring compounds described in U.S. Pat. Nos. 2,173,628, 2,324,123, 2,444,608, etc. In addition, antifogging agents are described in Kagaku Shashin Binran, vol. II, p. 119 (Maruzen, 1959).

Further, hydroxylamine sulfate or hydrochloride, sodium sulfite, potassium sulfite, potassium bisulfite, or sodium bisulfite can be added to the developer.

Optionally development accelerators may be added to the developer, if necessary. Such development accelerators include cationic compounds such as various pyridinium compounds such as those described in U.S. Pat. No. 2,648,604, Japanese Pat. Publication No. 9,503/69 and U.S. Pat. No. 3,671,247, etc., cationic dyes such as phenosafranine, etc., netural salts such as thallium nitrate, potassium nitrate, etc., nonionic compounds such as polyethylene glycol or the derivative thereof described in Japanese Pat. Publication No. 9,504/69, U.S. Pat. Nos. 2,533,990, 2,531,832, 2,950,970 and 2,577,127, etc., and polythioethers, organic solvents described in Japanese Pat. Publication No. 9,509/69 and Belgian Pat. No. 682,862, organic amines, ethanolamine, ethylenediamine, diethanolamine, etc. In addition, there are included accelerators described in L. F. A. Mason; *Photographic Processing Chemistry,* pp. 40–43 (Focal Press-London, 1966).

Furthermore, benzyl alcohol, phenylethyl alcohol described in U.S. Pat. No. 2,515,147, pyridine as described in *Journal of Photographic Society of Japan,* vol. 14, p. 74 (1952), ammonia, hydrazine, amines, etc. are effective development accelerators.

In order to introduce the hydroxynaphthalene compounds of the present invention into a hydrophilic colloid constituting a silver halide photographic light-sensitive material, various known processes can be employed. Where the hydroxynaphthalene compound of the present invention is soluble in water, it can be added to the hydrophilic colloid as an aqueous solution in a suitable concentration. Where the hydroxynaphthalene compound is soluble in organic solvents, it can be added to the hydrophilic colloid constituting a photographic layer as a solution by dissolving it in a solvent which does not detrimentally influence the photographic properties. Such solvents are selected from among low-boiling organic solvents and water-miscible organic solvents such as alcohols (e.g., methanol, ethanol, isopropanol, butanol, etc.), ethers (e.g., dimethyl ether, ethyl methyl ether, diethyl ether, 1-ethoxypropane, etc.), glycols (e.g., 1,2-ethanediol, 1,2-propanediol, 1,3-propanediol, etc.), ketones (e.g., acetone, methyl ethyl ketone, 3-pentanone, etc.), esters (e.g., ethyl formate, methyl acetate, ethyl acetate, etc.) and amides (e.g., formamide, acetamide, succinic acid amide, etc.).

As an alternative process for introducing the hydroxynaphthalene compound of the present invention into the hydrophilic colloid constituting a photographic layer, there can be employed known processes for adding color couplers to hydrophilic colloid layers by emulsification. That is, the hydroxynaphthalene compound may be dissolved in an organic solvent in the manner described in U.S. Pat. No. 2,322,027 or 2,304,939, etc., emulsified and dispersed using a surface active agent, and the resulting emulsion dispersion added to a photographic hydrophilic colloid. As the organic solvent suited for this purpose, high-boiling organic solvents having a boiling point higher than about 175° C. and low-boiling organic solvents having a boiling point of about 30° C. to about 150° C. are used alone or in combination in optional proportions. As the low-boiling organic solvent, those illustrated hereinbefore can be used. As the high-boiling solvent, there can be used di-n-butyl phthalate, benzyl phthalate, triphenyl phosphate, tri-o-cresyl phosphate, diphenylmono-p-tert-butylphenyl phosphate, monophenyldi-p-tert-butylphenyl phosphate, diphenylmono-o-chlorophenyl phosphate, monophenyldi-o-chlorophenyl phosphate, 2,4-di-n-amylphenol, 2,4-di-t-amylphenol, N,N-diethylaurylamide, and trioctyl phosphate and trihexyl phosphate, etc. described in U.S. Pat. No. 3,676,137.

Where the 3-pyrazolidone compound or the hydroxynaphthalene compound is soluble in water or a low-boiling organic solvent, they can be added as a solution thereof to a hydrophilic colloid constituting a photographic layer. The hydroxynaphthalene compound or the 3-pyrazolidone compound can be introduced into a hydrophilic colloid constituting a photographic light-sensitive material in any of the steps for producing photographic light-sensitive materials, with the steps prior to coating, in particular the step of preparing the photographic coating solution, being desirable.

Where the hydroxynaphthalene compound or the 3-pyrazolidone compound of the present invention is soluble in water or a low-boiling organic solvent, they can be added to a developer as a solution by dissolving in such solvent in a proper concentration. Where the hydroxynaphthalene compound or the 3-pyrazolidone compound of the present invention is soluble in water, they may be added as a solid to a developer.

Ordinary photographic materials contain 3 to 10 $g/m^2$ silver salts (calculated as silver), and printing materials contain about 1 to 4 $g/m^2$ silver. On the other hand, the photographic material of the present invention contains coated silver in an amount of about 0.1 to about 8 $g/m^2$, preferably 0.5 to 7 $g/m^2$, and in general the amount of silver can be reduced by at least 20% in comparison with an analogous conventional type photographic material put to the same use.

A silver halide emulsion is usually prepared by mixing a solution of water-soluble silver salt (e.g., silver nitrate, etc.) with a solution of a water-soluble halide (e.g., potassium bromide, etc.) in the presence of a solution of a water-soluble polymer such as gelatin. As the silver halide, there can be used mixed silver halides such as silver chlorobromide, silver bromoiodide, silver chlorobromoiodide, etc. as well as silver chloride and silver bromide. The form of these silver halide grains may be cubic, octahedral and the mixed forms thereof.

Also, two or more silver halide photographic emulsions separately prepared may be used by mixing them. Further, silver halide grains which are uniform to the core, silver halide grains wherein the inner portion and exterior portion form different layers, and so-called conversion type silver halides as described in British Pat. No. 635,841 and U.S. Pat. No. 3,622,318 may be used. Either a silver halide forming a latent image mainly on the surface of the grain or a silver halide forming a latent image within the grain may be used. These photographic emulsions are also described in Mees; *The Theory of Photographic Process* (published by MacMillan Co.), P. Grafkides; *Chimie Photographique* (published by Paul Montel, 1957), and the like, and can be prepared according to various processes commonly accepted, such as an ammoniacal process, a neutral process, an acidic process, etc.

The above-described silver halide emulsion can be chemically sensitized in the conventional manner. As the chemically sensitizing agents, there are illustrated, for example, gold compounds such as chloroauric acid salt, auric chloride, etc. as described in U.S. Pat. Nos. 2,399,083, 2,540,085, 2,597,856 and 2,597,915, salts of noble metals such as platinum, palladium, iridium, rhodium, ruthenium, etc. described in U.S. Pat. Nos. 2,448,060, 2,540,086, 2,566,245, 2,566,263, 2,598,079, etc., sulfur compounds capable of reacting with a silver salt to form silver sulfide as described in U.S. Pat. Nos. 1,574,944, 2,410,689, 3,189,458, 3,501,313, etc., stannous salts as described in U.S. Pat. Nos. 2,487,850, 2,518,698, 2,521,925, 2,521,926, 2,694,637, 2,983,610, 3,201,254, etc., amines and other reducing substances.

In some cases, it is preferable to further add various additives in order to obtain the desired development property, image property, film property, etc. As such additives, salt form iodides, organic compounds having a mercapto free group such as phenylmercaptotetrazole, etc., and alkali metal iodide salts may be incorporated. However, it is desirable to avoid using them in large amounts.

Antifogging agents added to a light-sensitive silver halide emulsion and non-light-sensitive auxiliary layers of a light-sensitive material may generally be used in combination with the compounds of the present invention. As other additives, a hardener, plasticizer, lubricant, surface agent, brightening agent and others known in the photographic field may be incorporated in a photographic element.

As the hydrophilic colloid used, there are illustrated, for example, gelatin, colloidal albumin, casein, cellulose derivatives (e.g., carboxymethyl cellulose, hydroxyethyl cellulose, etc.), sugar derivatives (e.g., agar-agar, sodium alginate, starch derivative, etc.), synthetic hydrophilic colloids (e.g., polyvinyl alcohol, poly-N-vinyl pyrrolidone, polyacrylic acid copolymer, polyacrylamide, the derivatives or partially hydrolyzed products thereof, etc.). If necessary, a compatible mixture of two or more of these colloids may be used. Of these, the most generally used is gelatin. Gelatin can be replaced partially or wholly by a synthetic polymer and, in addition, so-called gelatin derivatives may be used.

Photographic emulsions may, if necessary, be subjected to spectral sensitization or supersensitization using cyanine dyes such as cyanine, merocyanine, carbocyanine, etc. alone or in combination, or in further combination with styryl dyes, etc. Color-sensitizing techniques are well known and, for example, there are related descriptions in U.S. Pat. Nos. 2,493,748, 2,519,001, 2,977,229, 3,480,434, 3,672,897, 3,703,377, 2,688,545, 2,912,329, 3,397,060, 3,615,635, 3,628,964, British Pat. Nos. 1,195,302, 1,242,588, 1,293,862, West German Patent OLS Nos. 2,030,326, 2,121,780, Japanese Pat. Publication Nos. 4,936/68, 14,030/69, 10,773/68, U.S. Pat. Nos. 3,511,664, 3,522,052, 3,527,641, 3,615,613, 3,615,632, 3,617,295, 3,635,721, 3,694,217, British Pat. Nos. 1,137,580, 1,216,203, etc. These techniques can be selected based on the end-use of the light-sensitive materials such as the wavelength region to be sensitized, the sensitivity, and the like.

As the photographic support, there are illustrated a cellulose nitrate film, a cellulose acetate film, a cellulose butyrate film, a cellulose acetate propionate film, a polystyrene film, a polyethylene terephthalate film, a polycarbonate film, laminates thereof, thin glass film, paper, etc. commonly used for photographic light-sensitive materials. Papers coated or laminated with baryta or $\alpha$-olefin polymers, in particular polymers of $\alpha$-olefins having 2 to 10 carbon atoms such as polyethylene, polypropylene, ethylene-butene copolymer, etc., plastic films whose surface has been made rough to improve intimately the adhesive property with other polymer substances as described in Japanese Pat. Publication No. 19,068/72, and like supports can also provide good results.

As the suitable supports, transparent or opaque supports selected depending upon the end-use of the light-sensitive materials may be used. Also, with transparent supports, not only transparent, colorless ones but transparent supports colored by adding dyes or pigments can be used as well. This has heretofore been conducted with X-ray film and is disclosed, for example, in *J. SMPTE*, 67, p. 296 (1958), etc.

Opaque supports include those made of essentially opaque materials like paper and, in addition, those prepared by adding dyes or pigments like titanium oxide to a transparent film, a plastic film having been surface-treated according to the method described in Japanese Pat. Publication No. 19,068/72, papers or plastic films to which carbon black, dyes or the like have been added to make them completely light-intercepting, and the like. Also, a subbing layer may be provided having adhesiveness for both the support and the photographic emulsion layer. In order to further improve the adhesion property, the surface of the support may be subjected to pretreatments such as corona discharge, irradiation with ultraviolet rays, flame treatment, etc.

The photographic element layer may be coated according to various coating methods including dip-coating, air-knife coating, curtain coating, and extrusion coating using a hopper described in U.S. Pat. No. 2,681,294.

In addition, the principles of other image-intensifying processes described below can be utilized in combination with the process of the present invention. Descriptions on various photographic processes utilizing decomposition of a peroxide on the surface of a noble metal are found in West German Pat. OLS Nos. 1,813,920, 1,950,102, 1,955,901, 1,961,029, 2,044,833, 2,044,993, 2,056,360, 2,056,359, 2,120,091, etc. On the other hand, descriptions on color-intensifying processes utilizing a cobalt complex salts on the surface of noble metal are found in, for example, U.S. Pat. Nos. 3,822,129, 3,847,619, 3,902,905, 3,923,511, 3,989,526, 4,035,187, and 4,057,428, and British Pat. No. 1,456,542. Also, a color-intensifying process using chlorite, bromite or iodite is described in U.S. Pat. No. 4,043,814.

The present invention will be described in more detail in the following examples. This invention is not, however, limited to the specific embodiments making up the examples. Unless otherwise indicated, all parts, percents, ratios, etc. are by weight.

EXAMPLE 1

A photographic light-sensitive marterial comprising a polyethylene terephthalate film having coated on one side thereof a gelatino-silver bormoiodide emulsion (silber iodide: 1.5 mol %; gelatin: 50 g/mol Ag) in an amount of 40 mg of silver (as silver halide) per 100 $cm^2$ and 50 mg of gelatin per 100 $cm^2$, and a gelatin protective layer in an amount of 20 mg/100 $cm^2$ (Sample A), and a photographic light-sensitive material comprising a polyethylene terephthalate film having coated on the both sides thereof the above-described emulsion layer and the protective layer (Sample B) were respectively exposed and subjected to the following processings using a roller-conveying type processor described below.

| Step | Processing Temperature | Processing Time |
|---|---|---|
| Development | 35° C. | 25 sec |
| Fixing | 34° C. | 25 sec |
| Washing | 33° C. | 25 sec |
| Drying | 35° C. | 15 sec |

Compositions of the developer and the fixing solution used are as follows.

| Developer | |
|---|---|
| Water | 500 ml |
| Hydroxyethylethylenediamine-triacetic Acid | 0.8 g |
| Sodium Sulfite (anhydrous) | 5.0 g |
| Potassium Hydroxide | 20.0 g |
| Hydroxynaphthalene Compound | Table 1 |
| 3-Pyrazolidone Compound | Table 1 |
| Boric Acid | 10.0 g |
| Triethylene Glycol | 25.0 g |
| Glutaraldehyde (10% aq. solution) | 5.0 g |
| Glacial Acetic Acid | 3.0 g |
| Sodium Bisulfite (anhydrous) | 4.5 g |
| 5-Nitro-indazole | 0.03 g |
| 1-Phenyl-5-mercaptotetrazole | 0.005 g |
| 5-Methylbenzotriazole | 0.005 g |
| Potassium Bromide | 6.0 g |
| Water to make | 1.0 liter |

pH of the developer was about 10.30 at 20° C.

| Fixing solution | |
|---|---|
| Water | 500 ml |
| Ammonium Thiosulfate | 200.0 g |
| Sodium Sulfite (anhydrous) | 20.0 g |
| Boric Acid | 8.0 g |
| Disodium Ethylenediaminetetraacetate | 0.1 g |
| Aluminum Sulfate | 15.0 g |
| Sulfuric Acid | 2.0 g |
| Glacial Acetic Acid | 22.0 g |
| Water to make | 1.0 liter |

pH of this fixing solution was about 4.10 at 20° C.

The processor used as "Fuji RN (made by Fuji Photo Film Co.)", an automatic developer for X-ray film, which requires 90 seconds for the total processing.

In order to examine the dye contribution rate, the samples of this invention (Run Nos. 1–4) and for comparison (Run Nos. 7–9) were immersed in a solution having the following composition at 33° C. for 5 mins., thereby to remove silver from the photographic images.

| | |
|---|---|
| Ammonium thiosulfate (70%) | 150 ml. |
| Sodium sulfite | 5 g. |
| $Na[Fe^{+++}(EDTA)]$ | 40 g. |
| EDTA | 4 g. |
| water to make 1 liter. | |

Measured data of photographic images are shown below.

TABLE 1

| Run No. | Sample | Coated Ag (g/100 cm²) | Hydroxynaphthalene Compound | Amount added (g/l) | Pyrazolidone Compound | Amount added (g/l) | Fog | Maximum Density ($D_{max}$) Total Density | Dye Density* | DCR** (%) | Note |
|---|---|---|---|---|---|---|---|---|---|---|---|
| 1 | A | 0.04 | 1,5-Dihydroxynaphthalene | 6.4 | 1-Phenyl-3-pyrazolidone | 1.5 | 0.25 | 2.57 | 0.82 | 31.9 | Invention |
| 2 | A | 0.04 | 1,5-Dihydroxynaphthalene | 6.4 | 1-Phenyl-4,4-dihydroxymethyl-3-pyrazolidone | 1.5 | 0.26 | 2.92 | 1.17 | 40.1 | " |
| 3 | A | 0.04 | 1,7-Dihydroxynaphthalene | 6.4 | 1-Phenyl-4,4-dihydroxymethyl-3-pyrazolidone | 1.5 | 0.25 | 2.38 | 0.68 | 28.6 | " |
| 4 | A | 0.04 | 1,6-Dihydroxynaphthalene | 6.4 | 1-Phenyl-4,4-dihydroxymethyl-3-pyrazolidone | 1.5 | 0.24 | 2.26 | 0.62 | 27.4 | " |
| 5 | A | 0.04 | 1,5-Dihydroxynaphthalene | 6.4 | — | — | 0.16 | 0.43 | 0.30 | —*** | Comparison |
| 6 | A | 0.04 | — | — | 1-Phenyl-3-pyrazolidone | 1.5 | 0.23 | 0.82 | 0.25 | — | " |
| 7 | A | 0.04 | Hydroquinone | 25 | 1-Phenyl-3-pyrazolidone | 1.5 | 0.26 | 1.81 | 0.29 | 16.0 | " |
| 8 | B | 0.08 | Hydroquinone | 25 | 1-Phenyl-3-pyrazolidone | 1.5 | 0.27 | 2.84 | 0.31 | 10.9 | " |
| 9 | A | 0.04 | Following Compound* | 3.3 | 1-Phenyl-4,4-dihydroxymethyl-3-pyrazolidone | 1.5 | 0.36 | 1.27 | 0.46 | 36.2 | " |

*The dye density was measured after removing silver from the photographic images in a manner described above.
**Dye Contribution Rate(%): percentage of a dye image to the total image density
***The dye contribution rate is of no significance since $D_{max}$ of the total image is too low.

* 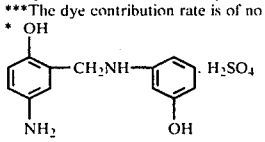

(developer-coupler compound described in U.S. Pat. No. 3,622,629)

Sample A provided high maximum density (Dm) when processed according to the process of the present invention (Run Nos. 1–4) utilizing both silver image and color image though it contained silver in only half the amount compared with sample B. On the other hand, in the case of the conventional processing (utilizing silver image alone) using hydroquinone and 1-phenyl-3-pyrazolidone, maximum density was seriously reduced when the amount of coated silver was reduced to ½ (Run No. 7).

Also, in the case of using a developer-coupler compound described in U.S. Pat. No. 3,622,629 which utilizes both silver image and color image, maximum density (Dm) was seriously reduced and fog increased when the amount of coated silver was reduced to ½ (Run No. 9).

Further, as will be easily understood by comparing Run Nos. 1 to 4 with Run Nos. 5 and 6, the effect of the present invention is attained only by using the naphthalene compound and the pyrazolidone derivative in combination. The use of only one of them alone provided only a low maximum density.

As will also be understood by comparing Run Nos. 1 to 4 with Run Nos. 7 and 8, the dye contribution rate is much greater in the samples of this invention than those for comparison. Although Run No. 9 for comparison provided the dye contribution rate of 36.2%, the absolute value of its $D_{max}$ is about ½ time that of Run No. 3 having the lowest $D_{max}$ value in the system of this invention and fog was seriously caused.

From the results above, it is understood that only the system of the present invention can provide photographic images where the dye contribution rate is at least 20% based on the total image density, while retaining the sufficiently high image density with a reduction in the consumption of silver and without causing fog.

EXAMPLE 2

A photographic light-sensitive material comprising a polyethylene terephthalate film having on the one side thereof a 1,5-dihydroxynaphthalene-containing gelatino-silver bromoliodide emulsion layer (AgI: 1.5 mol %) coated in an amount of 40 mg of silver (as silver halide) per 100 cm², 5 mg of 1,5-dihydroxynaphthalene (added to the coating solution as a methanol solution) per 100 cm², and 50 mg of gelatin per 100 cm², and a gelatin protective layer in an amount of 20 mg of gelatin per 100 cm² (Sample C) was imagewise exposed, and processed in the same manner as in Example 1. The results thus obtained are shown in Table 2.

TABLE 2

| Run No. | Sample | Coated Ag (Ag g/100 cm²) | Developer | Amount added (g/l) | Pyrazolidone Compound | Amount added (g/l) | Fog | Maximum Density Total Density | Maximum Density Dye Density | Dye Contribution Rate (%) |
|---|---|---|---|---|---|---|---|---|---|---|
| 10 | C | 0.04 | none | none | 1-Phenyl-4,4-dihydroxymethyl-pyrazolidone | 1.5 | 0.25 | 3.15 | 1.29 | 41.0 |
| 11 | B | 0.08 | Hydroquinone | 25 | 1-Phenyl-4,4-dihydroxymethyl-3-pyrazolidone | 1.5 | 0.26 | 2.82 | 0.31 | 11.0 |

Note:
The dye density and dye contribution rate were determined in a manner similar to Example 1.

The image of the sample of Run No. 10 comprised silver image and dye image and, as a result, it has a sufficiently high maximum density (Dm) in spite of the small amount of coated silver. On the other hand, the sample of Run No. 11 did not contain the naphthalene compound of the present invention, and hence the image formed after development comprised silver image alone. As a result, Run No. 11 produced a low maximum density in spite of the large amount of coated silver. The dye contribution rate of Run No. 10 was much larger than that of Run No. 11.

EXAMPLE 3

A photographic light-sensitive material comprising a polyethylene terephthalate film having coated on one side thereof a gelatino-silver bromoiodide emulsion (silver iodide: 1.5 mol%; gelatin 50 g/mol Ag) in an amount of 40 mg. of silver (as silver halide) per 100 cm², 5 mg of naphthalene compounds as identified in Table 3 below per 100 cm² (added to a coating solution as a methanol solution) and 50 mg of gelatin per 100 cm², and a gelatin protective layer in an amount of 20 mg/100 cm² was exposed and subjected to processings similar to Example 1.

Measured data of photographic images are shown below, together with the dye contribution rate determined in a manner similar to Example 1.

TABLE 3

| Run No. | Coated Ag (g/100 cm²) | Naphthalene Compound | Amount added (g/100 cm²) | Pyrazolidone Compound | Amount added (g/l) | Fog Fog | Maximum Density Total Density | Maximum Density Dye Density | Dye Contribution Rate(%) | Note |
|---|---|---|---|---|---|---|---|---|---|---|
| 12 | 0.04 | 1,7-Dihydroxy-naphthalene | 0.005 | 1-Phenyl-4,4-dihydroxymethyl-3-pyrazolidone | 1.5 | 0.24 | 2.97 | 1.08 | 36.4 | Invention |
| 13 | " | 3-Sulfo-1,3-dihydroxy-naphthalene | " | 1-Phenyl-4,4-dihydroxymethyl-3-pyrazolidone | " | 0.23 | 1.51 | 0.24 | 15.9 | Comparison |
| 14 | " | 3-Carboxy-1,3-dihydroxynaphthalene | " | 1-Phenyl-4,4-dihydroxymethyl-3-pyrazolidone | " | 0.24 | 1.58 | 0.25 | 15.8 | " |
| 15 | " | 1,3-Dihydroxy-naphthalene | " | 1-Phenyl-4,4-dihydroxymethyl-3-pyrazolidone | " | 0.24 | 1.72 | 0.39 | 22.7 | " |

As is clearly seen from the results above, the presence of a carboxy or sulfo group in the naphthalene nucleus prevents the formation of a dye image so that the net optical density became very low as compared to the carboxy- and sulfo-free dihydroxynaphthalene (see Run Nos. 13 and 14 versus Run No. 15). 1,7-Dihydroxynaphthalene used in the system of the present invention provided a sufficiently high maximum density (Run No. 12) with a great contribution of the dye image to the net density.

While the invention has been described in detail and with reference to specific embodiments thereof, it will be apparent to one skilled in the art that various changes and modifications can be made therein without departing from the spirit and scope thereof.

What is claimed is:

1. A process for forming photographic images consisting of a silver image and a dye image, which comprises development processing an imagewise exposed silver halide photographic light-sensitive material in the co-presence of (A) a naphthalene compound represented by formula (I):

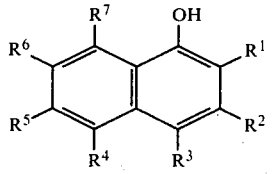

(I)

wherein $R^1$, $R^2$ and $R^3$ each represents a hydrogen atom or a hydrophobic group containing at least 8 carbon atoms, and $R^4$, $R^5$, $R^6$ and $R^7$ each represents a hydrogen atom, a hydroxy group or a hydrophobic group containing at least 8 carbon atoms, with at least one of $R^4$ through $R^7$ representing a hydroxy group, and (B) a 3-pyrazolidone compound, said co-presence being established by incorporating said naphthalene compound (A) and said 3-pyrazolidone compound (B) alone or in combination in a silver halide emulsion layer, a hydrophilic colloid layer associated with the silver halide emulsion layer, or a developing solution such that upon development said naphthalene compound (A) and said 3-pyrazolidone compound (B) react to form a dye image, thereby said dye image contributing to said photographic images by at least about 20%.

2. The process of claim 1, wherein said contribution of said dye image to the photographic images is between about 30 and about 60%.

3. The process of claim 1, wherein said naphthalene compound is at least one compound selected from the group consisting of 1,5-dihydroxynaphthalene, 1,7-dihydroxynaphthalene, and derivatives thereof.

4. The process of claim 1, wherein said pyrazolidone compound is represented by the formula (II)

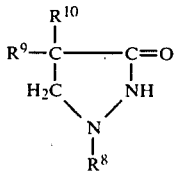

(II)

wherein $R^8$ represents an aryl group, and $R^9$ and $R^{10}$ each represents a hydrogen atom, an alkyl group or a hydroxyalkyl group.

5. The process of claim 4, wherein said 3-pyrazolidone compound is at least one compound selected from the group consisting of 1-phenyl-3-pyrazolidone, 1-phenyl-4,4-dimethyl-3-pyrazolidone, 1-phenyl-4-methyl-3-pyrazolidone, 1-phenyl-4-dihydroxymethyl-3-pyrazolidone, and the derivatives thereof.

6. The process of claim 5, wherein said hydroxynaphthalene compound is incorporated in a developer.

7. The process of claim 5, wherein said 3-pyrazolidone derivative is incorporated in a developer.

8. The process of claim 5, wherein both of said hydroxynaphthalene compound and said 3-pyrazolidone compound are incorporated in a developer.

9. The process of claim 5, wherein said hydroxynaphthalene compound is incorporated in a hydrophilic colloid layer constituting a silver halide photographic light-sensitive material.

10. The process of claim 5, wherein said 3-pyrazolidone compound is incorporated in a hydrophilic colloid layer constituting a silver halide photographic light-sensitive material.

11. The process of claim 5, wherein said hydroxynaphthalene compound is incorporated in a hydrophilic colloid layer constituting a silver halide photographic light-sensitive material and said 3-pyrazolidone compound is incorporated in a developer.

12. The process of claim 1, wherein said development processing fundamentally comprises developing, fixing and water-washing.

13. The process of claim 6, wherein said hydroxynaphthylene compound is present in said developer in an amount of about 0.1 to 30 g/l.

14. The process of claim 7, wherein said 3-pyrazolidone compound is incorporated in said developer in an amount of about 0.01 g/l to 5 g/l.

15. The process of claim 9, wherein said hydroxynaphthylene compound is incorporated into said light-sensitive material in an amount of about 0.1 g/m$^2$ to 10 g/m$^2$.

16. The process of claim 10, wherein said 3-pyrazolidone compound is incorporated into said light-sensitive material in an amount of about 0.01 g/m$^2$ to 5 g/m$^2$.

17. The process of claim 1, wherein said light-sensitive material contains silver halide in an amount of coated silver of about 0.1 to about 8 g/m$^2$.

18. A process for reducing a coating weight of silver by providing photographic images consisting of a silver image and a dye image which comprises development processing an imagewise exposed silver halide photographic light-sensitive material in the co-presence of (A) a naphthalene compound represented by formula (I):

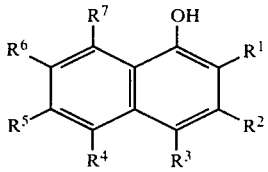

(I)

wherein $R^1$, $R^2$ and $R^3$ each represents a hydrogen atom or a hydrophobic group containing at least 8 carbon atoms, and $R^4$, $R^5$, $R^6$ and $R^7$ each represents a hydrogen atom, a hydroxy group or a hydrophobic group containing at least 8 carbon atoms, with at least one of $R^4$ through $R^7$ representing a hydroxy group, and (B) a 3-pyrazolidone compound, said co-presence being established by incorporating said naphthalene compound (A) and said 3-pyrazolidone compound (B) alone or in combination in a silver halide emulsion layer, a hydrophilic colloid layer associated with the silver halide emulsion layer, or a developing solution such that upon development said naphthalene compound (A) and said 3-pyrazolidone compound (B) react to form a dye image, thereby said dye image contributing to said photographic images by at least about 20%.

19. The process of claim 1 wherein said process additionally comprises the step of exposing said light-sensitive material to X-rays.

20. The process of claim 1 which consists essentially of development processing said imagewise exposed silver halide photographic light-sensitive material in the co-presence of said naphthalene compound (A) and said 3-pyrazolidone compound (B).

21. The process of claim 18 which consists essentially of development processing said imagewise exposed silver halide photographic light-sensitive material in the co-presence of said naphthalene compound (A) and said 3-pyrazolidone compound (B).

* * * * *